US008739596B2

(12) United States Patent
Nieschulz

(10) Patent No.: US 8,739,596 B2
(45) Date of Patent: Jun. 3, 2014

(54) WEDGE ACTIVATED ROTATING FILLER CAM UTILIZING A SADDLE FOR ROTATION

(75) Inventor: Daniel F. Nieschulz, Macomb, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 317 days.

(21) Appl. No.: 13/245,271

(22) Filed: Sep. 26, 2011

(65) Prior Publication Data

US 2013/0074574 A1 Mar. 28, 2013

(51) Int. Cl.
*B21D 5/04* (2006.01)

(52) U.S. Cl.
USPC ..... 72/452.9; 72/452.7; 72/312; 72/387

(58) Field of Classification Search
USPC ..... 72/312, 313, 314, 315, 319, 387, 388, 72/411, 452.7, 452.9
See application file for complete search history.

(56) References Cited

U.S. PATENT DOCUMENTS

| | | | | |
|---|---|---|---|---|
| 5,347,838 | A * | 9/1994 | Matsuoka | 72/313 |
| 5,404,742 | A | 4/1995 | Wilson et al. | |
| 6,038,908 | A * | 3/2000 | Kinoshita | 72/315 |
| 6,523,386 | B2 * | 2/2003 | Matsuoka | 72/312 |
| 7,013,783 | B2 | 3/2006 | Matsuoka | |
| 7,523,634 | B2 * | 4/2009 | Krozek | 72/313 |
| 7,624,615 | B2 | 12/2009 | Nieschulz | |
| 7,757,533 | B2 * | 7/2010 | Krozek | 72/313 |
| 2002/0124620 | A1 * | 9/2002 | Matsuoka | 72/312 |

FOREIGN PATENT DOCUMENTS

| | | | |
|---|---|---|---|
| EP | 2 320 102 | A2 | 5/2011 |
| JP | 11 285740 | A | 10/1999 |
| JP | 2006 116558 | A | 5/2006 |

* cited by examiner

*Primary Examiner* — David B Jones
(74) *Attorney, Agent, or Firm* — Ralph E Smith

(57) ABSTRACT

A rotating filler cam system including a lower die receiving at least one filler cam. The filler cam includes saddles that sit in saddle pockets of the lower die such that the filler cam is rotatably connected to the lower die. At least one wedge assembly is driven to contact the filler cam and rotate the filler cam from a first position to a second position.

11 Claims, 7 Drawing Sheets

WEDGE ACTIVATED ROTATING FILLER CAM UTILIZING A SADDLE FOR ROTATION

FIELD

The present disclosure relates to rotating filler cam systems, specifically to wedge activated rotating filler cams utilizing a saddle for rotation.

BACKGROUND

Two cams are generally used to form a flange on a sheet metal panel using a die. The first cam is a filler cam or anvil and the other cam is the form cam that forms or flanges the sheet metal around the filler cam. The filler cam is retracted after the forming process so the formed or flanged panel can be removed. The process may then be started over.

There are several types of cams that perform the above function. Of the types of cams that are available, a rotary filler cam is regarded as the best because these types of cams are able to fit into tight conditions. Rotary filler cams work in conjunction with an aerial form cam to form or flange the sheet metal. These types of cams, however, are expensive and are generally manufactured overseas.

Further, the use of an aerial form cam in conjunction with the rotary filler cam has drawbacks in that the aerial form cam is mounted to the upper die and can interfere with automation curves during panel transfers in the press, which can lead to process and styling changes. Moreover, aerial form cams are heavy and can add unbalanced weight to the upper die and press. This may present a problem when separating the die during construction, maintenance, and repair.

Accordingly, there is a need and desire for an improved cam system that overcomes the above-noted deficiencies.

SUMMARY

In one form, the present disclosure provides a wedge activated rotating cam system. The system comprises a rotating filler cam having a first end with a first saddle and a second end with a second saddle. The system also comprises a lower die having a first end with a first saddle pocket for receiving the first saddle and a second end with a second saddle pocket for receiving the second saddle.

The present disclosure also provides a wedge activated rotating cam assembly comprising a rotating filler cam having a first end with a first saddle and a second end with a second saddle; a lower die having a first end with a first saddle pocket for receiving the first saddle and a second end with a second saddle pocket for receiving the second saddle; first and second saddle keepers respectively positioned within the first and second saddles; first and second keepers respectively located on the first and second ends of the lower die; and a plurality of wedges. The wedges are driven by a drive mechanism to engage portions of said filler cam and to rotate said filler cam from a first position to a second position.

The system and assembly may utilize first and second saddle keepers respectively positioned within the first and second saddles and first and second keepers respectively located on the first and second ends of the lower die. The first and second keepers are adapted to maintain the first and second saddle keepers within the first and second saddles.

The system and assembly may use wear plates positioned between said wedges and the filler cam. The wedges may comprise wear plate keepers adapted to maintain the wear plates during rotation of the filler cam. In addition, the wedges and the first and second saddles may be located below the rotational axis of the filler cam.

Further areas of applicability of the present disclosure will become apparent from the detailed description provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

Figure 1:
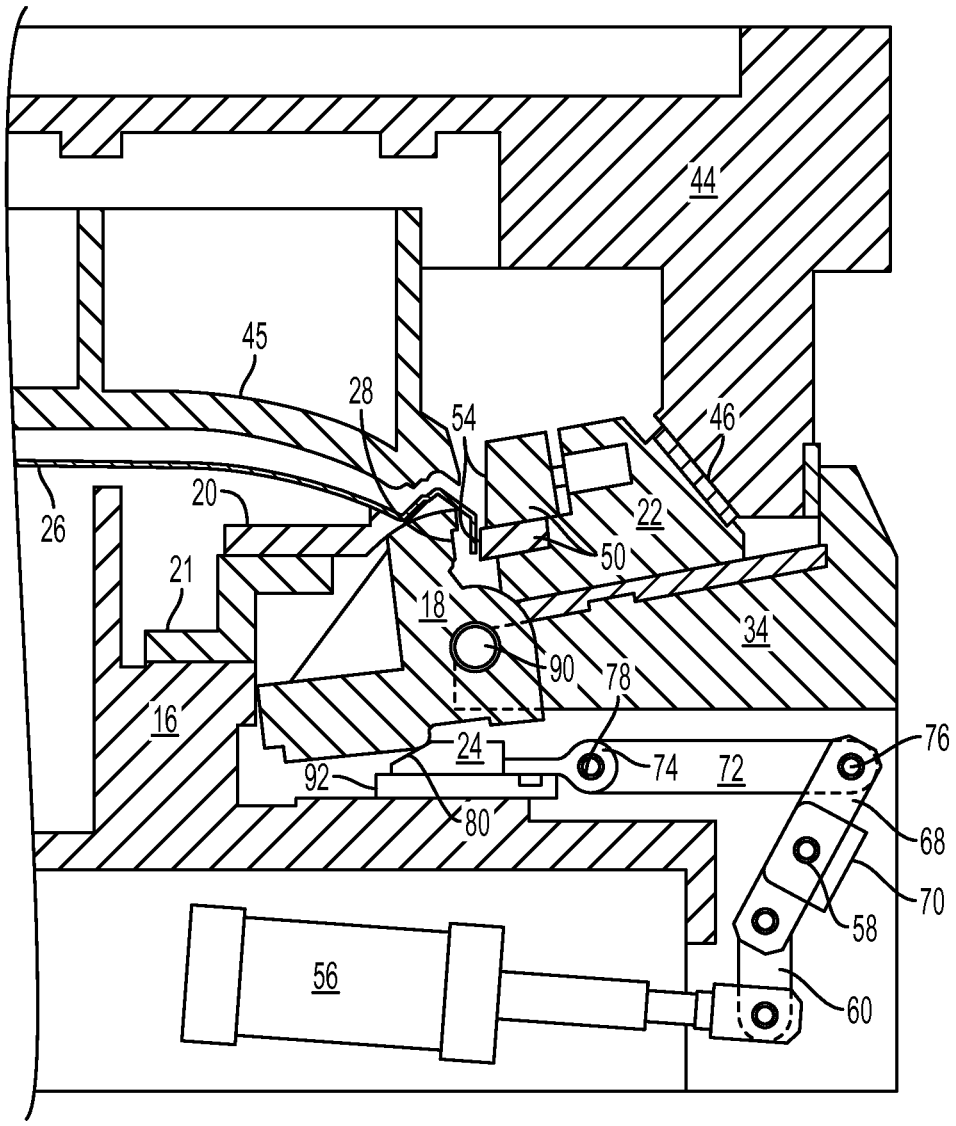
FIG. 1 PRIOR ART
FIG. 1 is an illustration of a prior art wedge activated rotating filler cam system.
Figure 2:
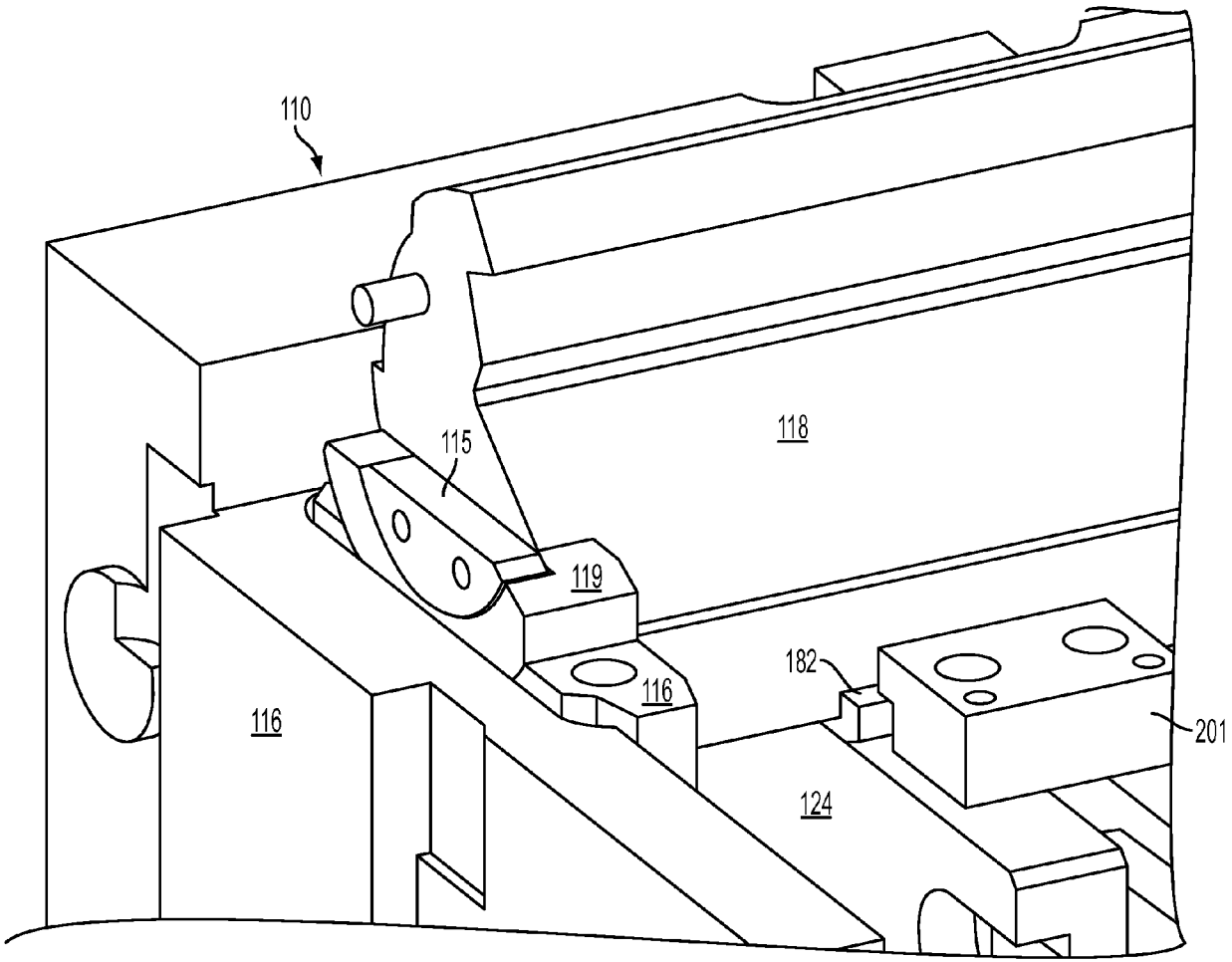
FIGS. 2-5 illustrate various views of a portion of a wedge activated rotating filler cam system according to embodiments disclosed herein.
Figure 3:
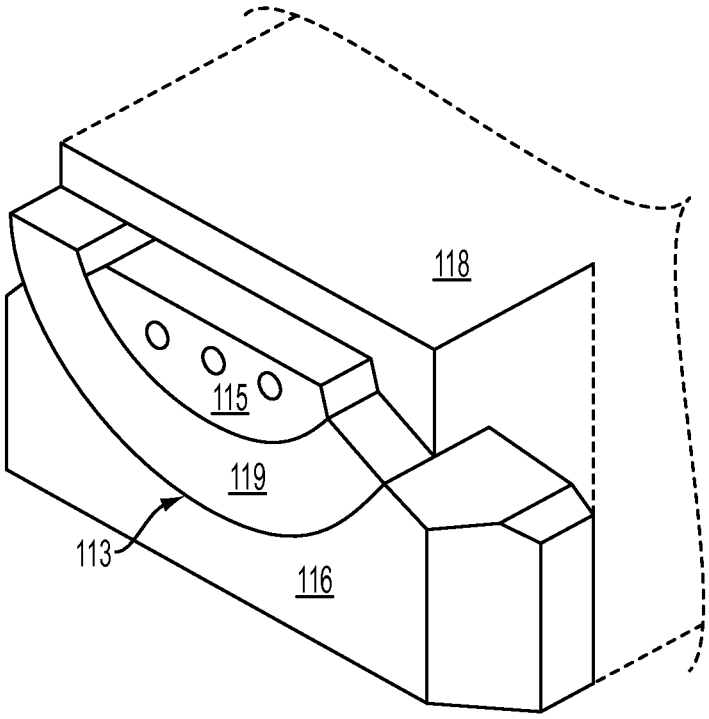

U.S. Pat. No. 7,624,615 discloses a wedge activated rotating filler cam system that addresses and overcomes some of the prior art shortcomings and is hereby incorporated by reference in its entirety. The '615 patented system comprises a rotating cam assembly disposed on a lower die 16. The assembly includes rotating filler cams 18, caps 20 and at least one forming cam 22. Each rotating filler cam 18 has a surface 28 that will transfer its shape to an edge of the metal substrate 26 that will be used to form e.g., a body panel, hood, or door for an automobile.

The caps 20 are mounted to an adapter 21. The forming cam 22 is held and supported by an adapter 34 and comprises a plurality of removable spacers 50, having a surface 54, and angled surfaces providing a bearing surface for an upper die 44 having a corresponding opposing surface 46. In operation, the upper die 44 will be lowered such that its surface 46 contacts the forming cam 22 to form/flange the substrate 26.

A wedge actuation assembly is used to move wedges 24 and comprises a drive mechanism 56 coupled to a drive shaft 58 by a rotating arm 60. When the drive mechanism 56 is activated between firing and non-firing states, the rotating arm 60 and the drive shaft 58 are rotated toward and away from the drive mechanism 56. As the drive shaft 58 rotates back and forth, a plurality of wedge assemblies are driven back and forth to engage and rotate the filler cams 18. Each wedge assembly includes an actuation arm 68 secured to the drive shaft 58 by locking plates 70. A hinged connection 76 couples drive arms 72 to the actuation arms 68. Another end 74 of the drive arms 72 is coupled to a wedge 24 via hinge 78. The wedges 24 are generally rectangular in shape, and include an angled surface 80 that engages the rotating filler cam 18.

In operation, when the wedges 24 engage the rotating filler cam 18, the rotating filler cam 18 is forced up the angled surface 80. The wedges 24 slide beneath the rotating filler cam 18 as it rotates about pivot point 90 to a forming/flanging position. As the die 44 is lowered, its surface 46 will contact and slide along the angled surface of the cam 22. Due to the mass of the upper die 44, the forming cam 22 will slide toward the filler cam 18. When the rotating filler cam 18 is in the forming/flanging position, the substrate 26 will be compressed between the filler cam 18 and forming cam 22. The rotating filler cam 18 is left in this position for a predetermined amount of time sufficient to form/flange the substrate 26. A slide plate 92 is used to provide a bearing surface and support surface for the wedges 24.

The inventor has determined that the system of the '615 patent can be improved by modifying the filler cam 18 and how it rotates about the lower die 16. As will be discussed below, the improvements will result in smaller filler cams. Moreover, the new arrangement provides rotation about the same axis (i.e., pivot point 90) as the prior art pivot pin technique, but allows the actuating surfaces to be lowered such that they are located below the axis of rotation. The lowering of the actuation surfaces minimizes interference issues and also allows the filler cam to get closer to the part being formed.

FIGS. 2-6 illustrate a portion of a wedge activated rotating filler cam system 110 constructed in accordance with the present disclosure. The system 110 comprises a novel rotating filler cam 118 having saddles 119 formed on the ends of the cam 118. The system 110 uses a lower die 116 having saddle pockets 113 formed on the ends of the die 116 for receiving the saddles 119. As will be described below, the saddle 119/saddle pocket 113 arrangement provides for rotation of the filler cam 118 without the pivot pin technique used in the '615 system.

In the illustrated embodiment, saddle keepers 115 are placed in the saddles 119. Keepers 117 are mounted on the outer ends of the lower die 116 to keep the saddle keepers 115 in the saddles 119 when the system 110 is in use. Holes may be formed through the saddle keepers 115 and may be used to engage the inside of the keepers 117, if desired.

The system 110 uses wedges 124 to rotate the filler cam 118 in substantially the same manner as the '615 system. As can bee seen in FIG. 4, drive arms 172 are connected to the wedges 124 for pushing the wedges 124 in the direction of the filler cam 118 and pulling the wedges 124 away from the filler cam 118 during the operation of the system 110. Although not shown, the drive arms 172 are connected to a drive mechanism (e.g., drive mechanism 56 of FIG. 1) via a drive shaft (e.g., drive shaft 58 illustrated in FIG. 1) and other components. Like the drive mechanism 56 of the '615 patent, the drive mechanism for system 110 can be e.g., an air cylinder or a hydraulic cylinder. Slide plates 192 are used to provide a bearing surface for the wedges 124 and can be made of any material suitable for this purpose. In addition, the slide plates 192 act as a support surface for the wedges 124. Moreover, guide rails 125 are disposed at the edges of the slide plates 192 to ensure proper tracking of the wedges 124 and to ensure that the wedges 124 engage the rotating filler cam 118 in a manner that is essentially normal to the filler cam 118. The guide rails 125 can be made of any material suitable for their purpose. The remainder of the system 110 comprises components that are the same or similar to the components used in the system disclosed in the '615 patent.

The wedges 124 of the present disclosure are generally rectangular in shape, but include an angled surface 180 that in operation engages the rotating filler cam 118. Unlike the wedges 24 used in the '615 patent, the disclosed wedges 124 are constructed as a single piece unit. The wedges 124 may be made of steel or any other hardened alloy suitable for rotating the filler cam 118 without being deformed or breaking. Wear plates 182 are used to protect the rotating filler cam 118 from the frictional forces experienced when the wedges 124 engage the filler cam 118 and can be made of any material suitable for this purpose. The plates 182 and wedges 124 are replaceable units so that during operation of the rotating filler cam system 110, these units can be removed and replaced as needed. Accordingly, the useful life of the rotating filler cam system 110 can be lengthened.

Figure 4:
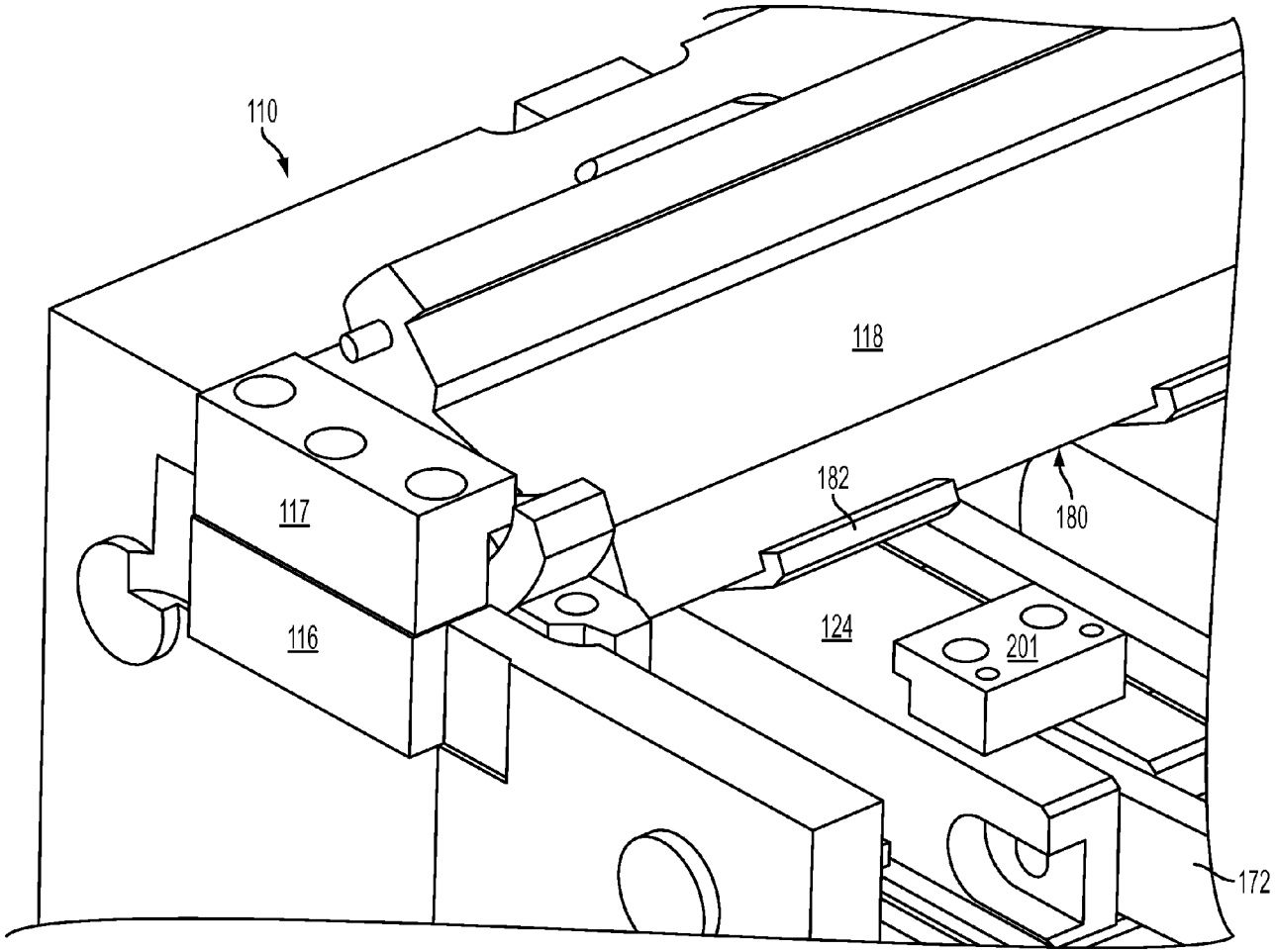
Figure 5:
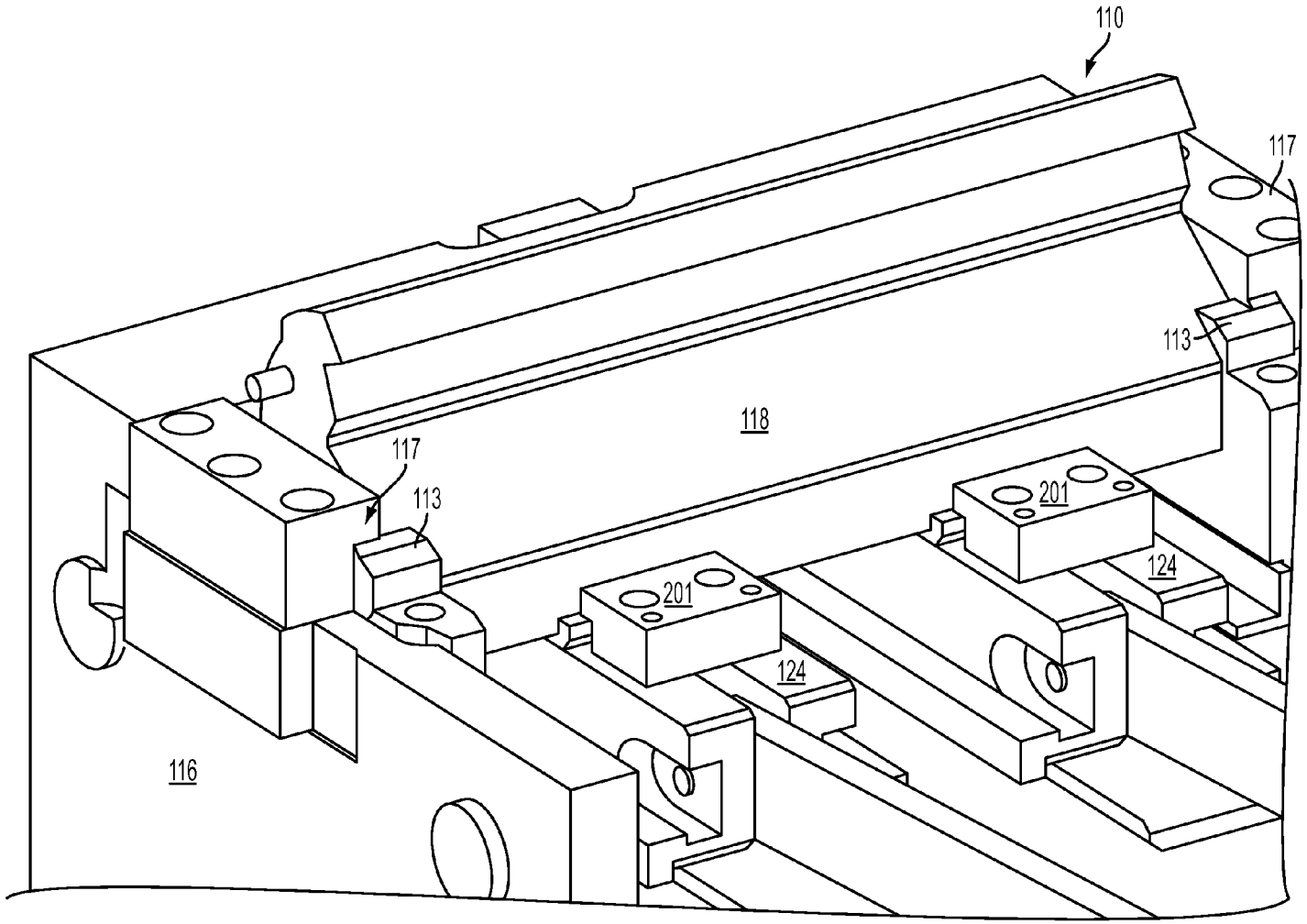
Figure 6:
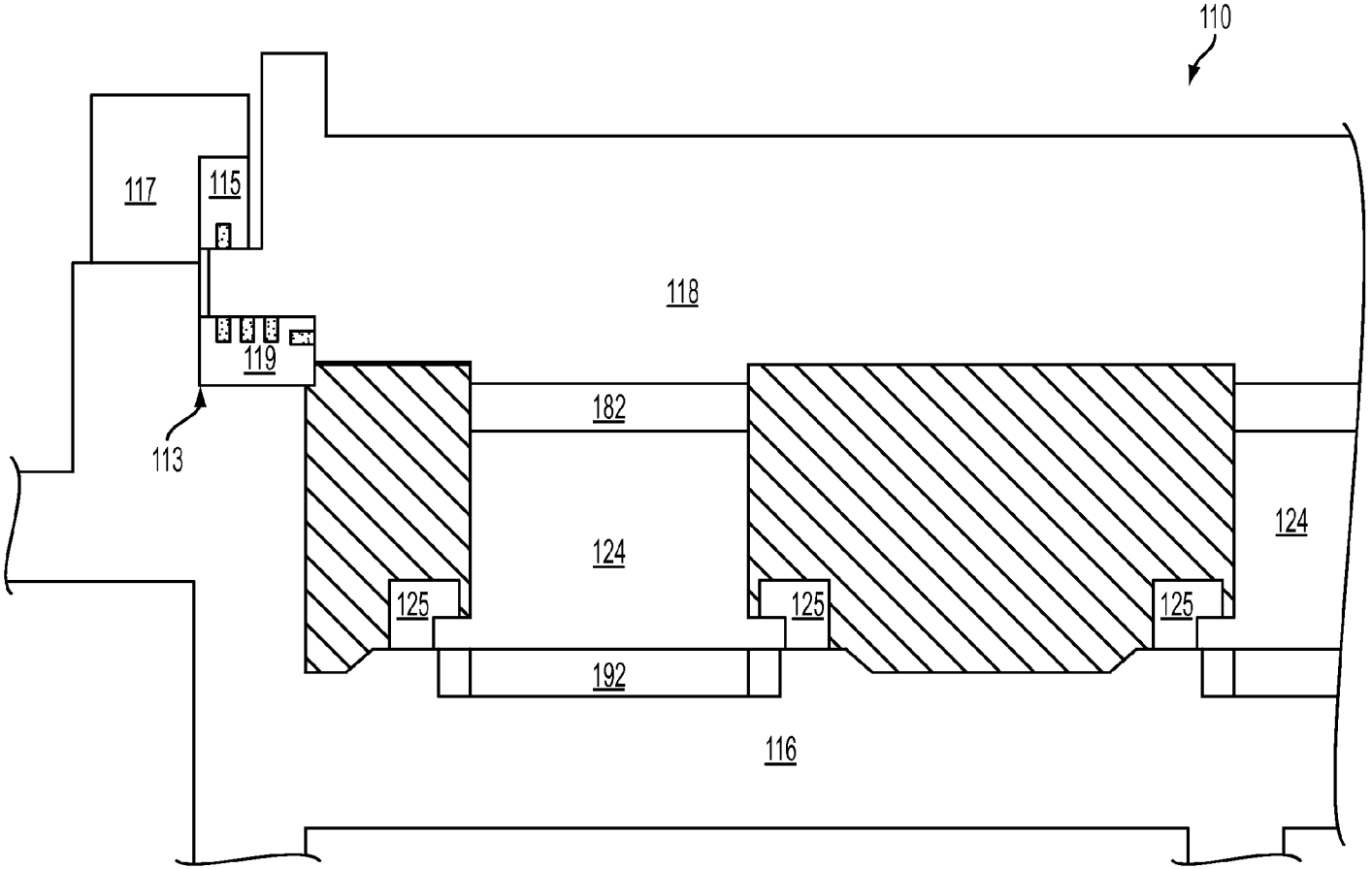
FIG. 6 illustrates a sectional view of the wedge activated rotating filler cam system illustrated in FIGS. 2-5 sectioned through the cam rotational axis.

In a desired embodiment, a wear plate keeper 201 is attached to the wedges 124. When the wedges 124 fully engage the rotating filler cam 118 (shown in FIG. 2) such that the cam 118 is in the forming/flanging position, the wear plate keepers 201 are in a position such that they overhang the wear plates 182. This serves to keep the wear plates 182 in position during the forming/flanging operation. However, when the wedges 124 are in the retracted position (i.e., not contacting the filler cams 118 as is shown in FIG. 4), the wear plate keepers 201 are positioned away from the wear plates 182.

It should be appreciated that the system 110 could comprise more than one rotating filler cam 118 if needed for the particular application. Moreover, the rotating filler cam 118 may have any shape desired to one skilled in the art. It should also be appreciated that the filler cam 118 may consist of any material sufficient for forming or flanging the metal substrate 26. Although hardened alloy steels are preferred, it is not out of the scope of the present teachings to use a rotating filler cam 118 formed of some other suitable material with a sufficient hardness and mass that can withstand forming and flanging metal substrates such as steel. The saddle keepers 115 may be comprised of the same material used for the filler cam 118, although the embodiment is not to be limited to the type of material used for the saddle keepers 115 or the filler cam 118.

Figure 7:
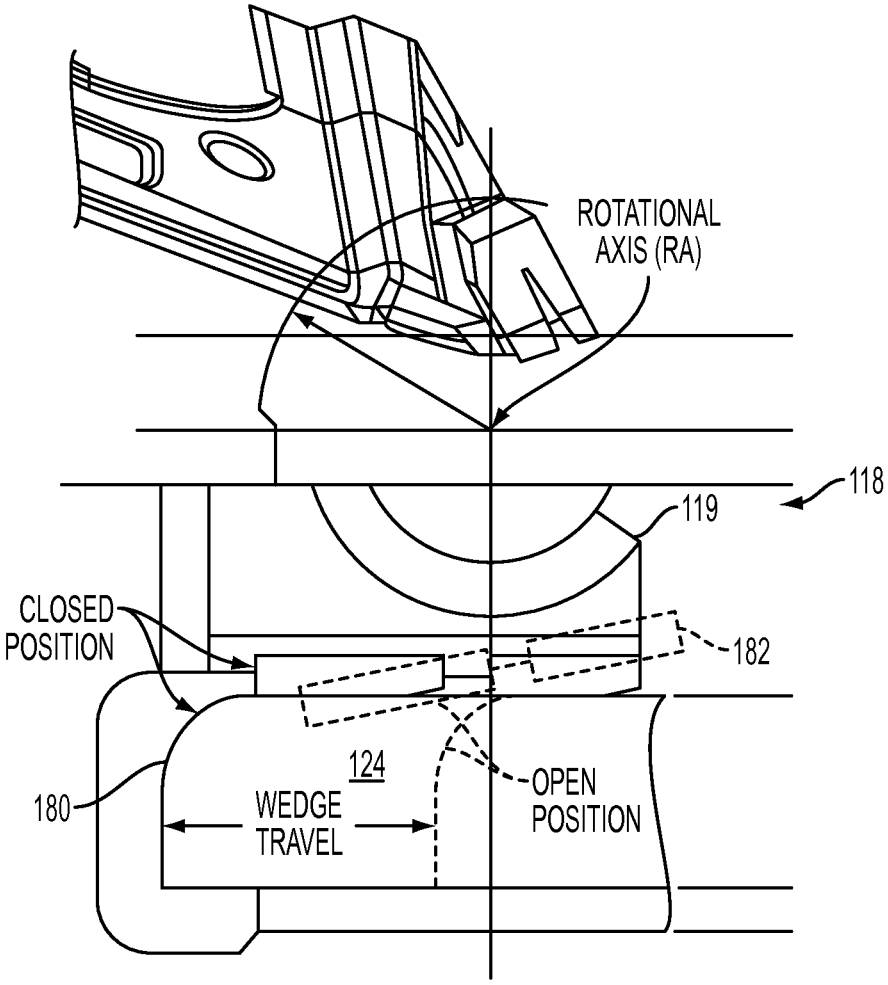
FIG. 7 illustrates the rotational axis of a rotating filler cam used in the system illustrated in FIGS. 2-5.

FIG. 7 illustrates the rotational axis RA of the rotating filler cam 118 used in the system 110 disclosed herein. As can be seen, when the wedges 124 move from the open position (i.e., retracted such that they are not contacting the filler cam 118) to the closed position (i.e., fully engaging the filler cam 118), they contact the filler cam 118 (via wear plates 182) to rotate the filler cam 118 to the forming/flanging position shown in FIG. 2. As shown in FIG. 7, the wear plates 182 will move from their open position (i.e., slightly angled with respect to the top surface of the wedges 124) to their closed position (i.e., planar with respect to the top surface of the wedges 124). Meanwhile, the filler cam 118 rotates about the rotational axis RA, which is about the same as the pivot point 90 of the prior art system, but above the saddle 119 in the present embodiment. This means that the actuating surfaces of the wedges 124, plates 182 and filler cam 118 used for the rotation are located below the rotational axis RA, which minimizes interference issues and also allows the filler cam 118 to get closer to the part being formed.

As mentioned above, this also allows for smaller filler cams 118. The prior art filler cams rotated about a pin, which required the filler cam to include extra material around the pin for structural reasons. Furthermore, to minimize interference with pin rotated filler cams it is necessary to build up the forming portion of the filler cam so it is spaced from the pin. In contrast, the saddle rotated filler cam of the current disclosure eliminates the interference concerns by moving the actuation surfaces rather than adding material and size to the filler cam 118.

It should be appreciated that the novel filler cam 118/lower die 116 arrangement can be implemented in a direct drive manner similar to the direct drive embodiment illustrated in the '615 patent. That is, the wedges 124 may be connected via the drive arms 172 to a frame that is driven back and forth by a drive mechanism without the use of rotating shafts. It should be understood that although a plurality of wedges 124 are shown in the disclosed embodiments, only a single wedge may be required to rotate the rotating filler cam 118, if desired.

What is claimed is:

1. A wedge activated rotating cam system comprising:

a rotating filler cam having a first end with a first saddle and a second end with a second saddle;

a lower die having a first end with a first saddle pocket for receiving the first saddle and a second end with a second saddle pocket for receiving the second saddle;

a first saddle keeper positioned within the first saddle; and a first keeper located on the first end of the lower die and being adapted to maintain the first saddle keeper within the first saddle.

2. The system of claim 1, further comprising:

a second saddle keeper positioned within the second saddle; and a second keeper located on the second end of the lower die and being adapted to maintain the second saddle keeper within the second saddle.

3. The system of claim 1, further comprising:

a wedge connected to a drive mechanism, said wedge being driven by the drive mechanism to engage a portion of said filler cam and to rotate said filler cam from a first position to a second position.

4. The system of claim 3, further comprising a wear plate positioned between said wedge and the filler cam, wherein said wedge comprises a wedge plate keeper adapted to maintain the wedge plate during rotation of the filler cam.

5. The system of claim 3, wherein said wedge and the first and second saddles are located below the rotational axis of the filler cam.

6. The system of claim 1, wherein the saddles and the saddle pockets allow the filler cam to be rotated from a first position to a second position.

7. A wedge activated rotating cam assembly comprising:

a rotating filler cam having a first end with a first saddle and a second end with a second saddle;

a lower die having a first end with a first saddle pocket for receiving the first saddle and a second end with a second saddle pocket for receiving the second saddle;

first and second saddle keepers respectively positioned within the first and second saddles;

first and second keepers respectively located on the first and second ends of the lower die; and a plurality of wedges adapted to be driven by a drive mechanism to engage portions of said filler cam and to rotate said filler cam from a first position to a second position.

8. The system of claim 7, wherein the first and second keepers are adapted to maintain the first and second saddle keepers within the first and second saddles.

9. The system of claim 7, further comprising wear plates positioned between said wedges and the filler cam, wherein said wedges comprise wear plate keepers adapted to maintain the slide plates during rotation of the filler cam.

10. The system of claim 7, wherein said wedges and the first and second saddles are located below the rotational axis of the filler cam.

11. The system of claim 10, wherein said wedges are constructed as a single piece of steel.

* * * * *